252-103 AU 166 EX
2/14/84 XR 4,431,559

United States Patent [19]
Ulrich

[11] 4,431,559
[45] Feb. 14, 1984

[54] DISHWASHING COMPOSITION AND METHOD

[75] Inventor: Robert J. Ulrich, Taylors, S.C.

[73] Assignee: Texize, Division of MortonThiokol, Greenville, S.C.

[21] Appl. No.: 309,016

[22] Filed: Oct. 6, 1981

[51] Int. Cl.[3] ..... C11D 7/12; C11D 7/54
[52] U.S. Cl. ..... 252/99; 252/94; 252/95; 252/103; 252/109; 252/156; 252/173; 252/550
[58] Field of Search ..... 252/94, 95, 99, 103, 252/109, 156, 173, 550

[56] References Cited

U.S. PATENT DOCUMENTS

| | | | |
|---|---|---|---|
| Re. 29,473 | 11/1977 | Fitzgerald, Jr. | 252/95 |
| 1,522,561 | 1/1925 | Weber et al. | 252/99 |
| 4,007,124 | 2/1977 | Collier et al. | 252/109 |
| 4,071,463 | 1/1978 | Steinhauer | 252/103 |
| 4,115,308 | 9/1978 | Guerry | 252/135 |

*Primary Examiner*—P. E. Willis, Jr.
*Assistant Examiner*—Robert A. Wax
*Attorney, Agent, or Firm*—Bailey & Hardaway

[57] ABSTRACT

Disclosed is a thixotropic automatic dishwasher composition having an aqueous solvent, a thickening agent, a source of chlorine, detergency levels of an anionic surfactant, builder salts and a buffer system to stabilize the chlorine source with the composition. The composition is dispensed by shearing the gel form of the thixotropic composition and thus having the composition develop the flow properties of a viscous liquid for the purpose of depositing the composition within the detergent compartment of an automatic dishwasher, but which quickly thereafter re-gels to acquire non-flowing properties unlike those of a liquid and substantially similar to the properties of a cohesive solid.

11 Claims, No Drawings

DISHWASHING COMPOSITION AND METHOD

BACKGROUND OF THE INVENTION

This invention relates generally to the art of dishwashing, and more particularly, to a composition for use within a household automatic dishwasher.

Conventional household automatic dishwashers operate with various wash cycles, all of which require the release of a detergent at an appropriate time during the wash cycle. The detergent is conventionally released from a storage compartment within the door of the automatic dishwasher. The detergent compartment is normally defined by a spring loaded door which at the appropriate time in the wash cycle opens to release the detergent within the compartment to the working volume of the dishwasher.

The household automatic dishwashing detergents which have been conventionally utilized are of granular or powder form and, to a large extent, extremely hygroscopic. The property of being highly hygroscopic has led to many problems within the automatic dishwashing art, both within the wash cycle and during storage of the detergent. The absorption and adsorption of moisture by a granular hygroscopic dishwashing detergent tends to inactivate the chlorine-containing agents, and causes the individual granules to cake and coalesce into larger particles, making the product difficult to dispense and dissolve, frequently ineffective and, in some cases, deleterious to the dishwashing process. This dissolving problem is worsened by energy saving strategies which result in the lowering of water temperatures within household dwellings.

Conventional household dishwashing detergent powders and granules generally require a water temperature of at least 130°-140° F. in order to be dissolved for the washing process; thus setting an absolute minimum water temperature for such products to be useful. In an automatic dishwasher, however, even with water at an appropriate temperature, automatic dishwashing detergents may cake within the detergent compartment prior to release to the wash cycle. Such caking causes difficulty in the formation of an aqueous solution which is necessary for detergent to occur and frequently results in deposition of granular and caked detergent particles upon articles being washed and adverse reaction therewith. Spotting and actual pitting of silverware and aluminum utensils can occur from the deposition of granular products during the wash cycle.

Household automatic dishwashing detergents conventionally contain chlorine bleach in order to remove stains and break down proteinaceous matter. The moisture which causes caking also reduces the chlorine stability particularly if chlorinated cyanurates are utilized in the granular detergent composition. Moisture thus presents a double threat to the efficacy of a granular detergent product.

A further problem brought about by the hygroscopic nature of granular dishwashing detergents is associated with the storage and dispensing thereof. Due to the caking which can result upon exposure to moisture, it is necessary that such hygroscopic detergents be stored in containers comprised of a barrier to moisture permeation. Such barrier packing materials are readily available, but complicate the packaging and dispensing schemes. Even with the utilization of barrier material, however, moisture still contacts the packaged material through the container opening, both during use and storage. This problem is exacerbated by the tendency to store such dishwashing detergents in the highly moist environment beneath a kitchen sink.

Attempts to overcome the shortcomings of granular products have been described in several prior art documents. Some attempts utilize a liquid medium rather than a granular medium for the dishwashing detergent. There is, however, a distinct problem with liquid products when it is attempted to dispense or retain the liquid within the detergent compartment of a household automatic dishwasher.

An additional problem associated with the use of a liquid medium is the presence of several constituents within the liquid medium which have a tendency to react with one another prior to the desired time of use within the wash cycle. For example, the prior art has utilized several different liquid products on an institutional level wherein one liquid product is dispensed into the wash cycle containing a surfactant and a separate distinct liquid product containing a source of chlorine is released into the wash cycle. No such dishwashing capability on a household scale, however, has permitted the use of more than one liquid at a time.

There is described in U.S. Pat. No. 4,226,736 to Bush et al a gelled dishwashing detergent containing a nonionic surfactant. The product disclosed therein, however, requires a minimum yield point in order to maintain the gelled product within the detergent compartment of an automatic dishwasher. The product described therein additionally contains no source of chlorine and thus would have to be utilized with the dual composition approach heretofore utilized on an institutional basis as discussed above.

SUMMARY OF THE INVENTION

It is thus an object of this invention to provide a non-granular composition for use within an automatic dishwasher.

It is a further object of this invention to provide such a non-granular product containing both detergency levels of surfactants and a bleach.

It is a still further and more particular object of this invention to provide such a dishwashing composition wherein a surfactant and a source of chlorine maintain stability during long periods of storage.

It is a still further object of this invention to provide a novel process of dispensing a dishwasher detergent product.

These as well as other objects are accomplished by a thixotropic composition having an aqueous solvent, a thickening agent, a source of chlorine, detergency levels of an anionic surfactant, builder salts and a buffer system to stabilize the chlorine source within the composition. The product is dispensed by shearing the gel form of the thixotropic composition and thus having the composition develop the flow properties of a viscous liquid for the purpose of depositing the composition within the detergent compartment of an automatic dishwasher, but which quickly thereafter re-gels to acquire non-flowing properties unlike those of a liquid and substantially similar to the properties of a cohesive solid.

DETAILED DESCRIPTION

In accordance with this invention it has been found that a thixotropic composition may be utilized as an automatic dishwashing detergent without the disadvantages heretofore associated with prior art compositions.

It has additionally been found that such a composition may contain both detergency levels of an anionic surfactant and a chlorine source. Surprisingly and unexpectedly the chlorine source is stable in the presence of an anionic surfactant within the the thixotropic composition of this invention. The chlorine source within the automatic diswasher detergent composition of this invention aids in the breakdown of proteinaceous organic material, helps remove food stains, aids in sanitizing, and aids in the prevention of water spotting.

The composition of this invention being thixotropic has the desirable attributes of a solid dishwashing detergent without the shortcomings thereof and simultaneously has the advantages of a liquid dishwashing detergent without the disadvantages thereof. These advantages will become apparent from the following description which will first describe the method of dispensing and using the composition of this invention.

The composition of this invention is stored in a container in a gel form. At the time of use, the container containing the gel is agitated or shaken so as to shear the gel and cause the gel to have flow properties substantially similar to the properties of a viscous liquid. The composition is then dispensed into the detergent compartment of an automatic dishwasher by dispensing in a manner similar to the dispensing of any liquid. The composition within the compartment regels into a nonflowable state without the now undesirable flow properties of a liquid. Having this property, the gel is retained within the detergent compartment of the dishwasher until it is introduced into the wash cycle. The gel possesses sufficient tenacity to be retained within the closed detergent compartment without leakage during the parts of the wash cycle wherein the closed detergent compartment is not utilized.

The gel, comprised to a large extent of an aqueous solution, does not require high temperature water to be activated or dissolved for its intended function within the wash cycle. Additionally because the composition is to a large extent an aqueous solution, it is not adversely affected by a moist environment.

The composition of this invention is a colloidal dispersion having thixotropic properties. For purposes of this disclosure the composition is referred to as a sol when it exhibits liquid like properties and a gel when it exhibits solid like properties.

Having generally set forth the process of utilizing the composition in accordance with this invention, the composition, itself, comprises a solvent, a thickening agent, a chlorine source, an anionic surfactant, a builder salt to retain removed soil within the wash liquid, and a buffer system to stabilize the chlorine source within the composition. An unexpected advantage of the composition of this invention is that the buffer system and builder salt perform not only their intended function but also act as electrolytes which interact with the thickening agent and bring about the thixotropic properties of the overall composition. The various constituents of the composition are discussed in detail in the description which follows.

Water is utilized to maintain in solution most active constituents of the composition with the exception of the thickening agents. However, some components may be present as separate phases and still be within the scope of this invention. For example, an antifoaming agent may be a separate phase or a builder salt may be present in excess of saturation. The aqueous solvent comprises a major portion of the overall composition and can be present in an amount of from about 45 to 60 percent by weight.

The key to the dispensing and retention of the composition of this invention within the storage compartment of an automatic dishwasher is the utilization of a thickening agent with functional electrolytes to bring about the thixtropic properties of the overall composition. The phenomenon of thixotropy is well known in the ceramic and clay technology art, but has not heretofore been utilized within an automatic dishwashing composition to create the advantages possessed by the composition of this invention. It is preferred to utilize conventional clays, silica, silicates and aluminosilicates as thickening agents in combination with salts and phosphates described below to create the thixotropic properties within the composition. The buffer system and builder salt act as electrolytes to interact with the fine clay or other particles and bring about the thixotropic properties. As examples, montmorillonite and bentonite clays may be utilized as well as colloidal silica and aluminosilicates. Generally, a thickening agent content of from about 2 to 5 percent by weight of the overall composition is sufficient to produce the thixotropic properties rendering the composition of this invention substantially dispensible as a liquid, but with the tenacity of a gel to maintain its presence within the detergent compartment of an automatic dishwasher.

The thickening agent in the composition of this invention provides not only the desirable attributes described in the preceding paragraph but may also act as a gentle abrasive to enhance the cleansing characteristics of the overall composition.

The chlorine source utilized within the composition of this invention adds significantly to the overall efficacy of the dishwashing composition. The chlorine source is desirably a hypochlorite and preferably an alkali hypochlorite. Examples of chlorine sources utilizable within this invention are sodium hypochlorite, lithium hypochlorite, calcium hypochlorite, and chlorinated trisodium phosphate. A problem with the prior art utilization of hypochlorites within a liquid solution has been the tendency for the hypochlorite to break down and form hypochlorous acid, HOCl, which is unstable and will not survive the necessary period of time required for efficacy in an household dishwashing detergent. In accordance with this invention, however, it has been found that such breakdown may be minimized by the utilization of a buffer system. Generally the chlorine source is present in an amount sufficient to increase the efficacy of the dishwashing composition and may be present in an amount from about 0.05 to about 5 percent by weight of the overall composition.

The buffer system in accordance with this invention is one which will maintain and establish a pH within the range of about 10 to 13 for the overall composition and which is sufficient to prevent acidic additions from forming significant quantities of hypochlorous acids and thus render the chlorine source ineffective. The buffer system is preferably a mixture of an alkali metal hydroxide and a salt. In addition to the builders, examples of buffering systems utilizable within the scope of this invention are sodium hydroxide and sodium bicarbonate or sodium hydroxide and sodium carbonate. Generally equal molar percentages of the buffer system are added and a general weight percentage range for each constituent would be from approximately 1 to 4 percent by weight of the overall composition.

A builder salt is included within the composition of this invention to maintain removed soil matter in suspension within the wash liquid. Such builder salt may be any of the prior art builder salts conventionally utilized. Examples of salts within the scope of this invention are trisodium phosphate and tetrapotassium pyrophosphate. Such builders may be present in an amount from about 2 to about 40 percent by weight of the overall composition. The builder salt also interacts with the buffer system and is actually a part thereof to maintain a desirable pH and stabilize the chlorine source.

It should again be emphasized that the buffer system and builder salt fulfill not only their primary function but act as electrolytes to interact with the thickening agent and bring about the thixotropic properties.

The anionic surfactant utilized within the composition of this invention must be one which is compatible with the chlorine source when the buffering system is utilized and which provides sufficient detergency for cleansing within an automatic dishwasher. The surfactant must be an anionic surfactant such as an alkali metal alkyl sulfate. The preferred anionic surfactant is sodium lauryl sulfate. Generally, a surfactant content from a 30 weight percent aqueous solution of sodium lauryl sulfate of from 0.5 to 4 percent by weight provides sufficient detergency for functioning in an automatic dishwasher environment.

While the essential components of the composition of this invention have been described above it should be pointed out that the composition once formulated is essentially a liquid solution with the thickeners being the only second phase. The thickeners create the thixotropic properties which provide for the unique dispensing and use characteristics of this invention. Other ingredients may, however, be utilized in the formulation so long as such ingredients do not interfere with the efficacy of the surfactant, chlorine source and buffering systems. Such other constituents for example may comprise colorants and perfumes in order to enhance the overall aesthetic appeal of the dishwashing composition.

Having generally described the composition in accordance with this invention, the following specific example is put forth as further aid to the understanding thereof.

EXAMPLE 1

Several batches of the following composition were prepared by mixing the components in the order listed below to a high degree of dispersion.

TABLE

| Component | Weight Percentage |
|---|---|
| Tap Water | 58% |
| Montmorillonite Clay | 2% |
| Fumed Silica of submicron size | 2% |
| Calcium Hypochlorite (65% active) | 2% |
| Tetrapotassium Pyrophosphate (anhydrous) | 30% |
| Anhydrous Soda Ash (sodium carbonate) | 2% |
| Sodium Lauryl Sulfate (30% aqueous solution) | 2% |
| Sodium Hydroxide (25% aqueous solution) | 2% |

The composition as prepared above typically had a relative viscosity, utilizing a Brookfield Viscometer with a helipath stand, T-E spindle, at 6 rpm of 16,000 to 75,000 centipoise was light yellow in color and had a density utilizing the pycnometer method of 1.31 grams per cc.

EXAMPLE II

Long range chlorine stability of the composition was measured by monitoring the active chlorine content. The results are listed below.

| Sample Age (months) | Percent Active Chlorine 77° F. | 100° F. |
|---|---|---|
| 0 | 1.09 | 1.09 |
| 2 | 0.87 | 0.65 |
| 4 | 0.68 | 0.40 |
| 6 | 0.54 | 0.23 |
| 8 | 0.49 | |
| 10 | 0.47 | |
| 12 | 0.36 | |

The composition after one year at 77° F. still retained more than sufficient chlorine to be efficacious in an automatic dishwasher. It is thus seen that the composition of this invention retained greater than thirty-three percent (33%) of its original active chlorine after one year at 77 degrees F.

The efficacy of the composition and its method of use was evaluated by dispensing the above composition into a dishwasher by shaking the container and the gelled product resulting in the transformation of the gel to a sol to permit liquid-like dispensing into the detergent compartment of the dishwasher. Immediately after dispensing into the detergent compartment, the composition regelled to have substantially non-flowing properties.

The automatic dishwasher contained dinner plates with soil material thereon. The material was baked onto the plate for 2½ hours at 200 degrees F. (93.3 degrees C.). The soil material comprised:

| Constituent | Weight |
|---|---|
| Ground Beef | 120 grams |
| Shredded Cheddar Cheese | 120 grams |
| Whole Homogenized Milk | 120 grams |
| Granulated White Sugar | 120 grams |
| Cherry Pie Filling | 120 grams |
| Raw Egg (excluding shell) | 1 grams |
| All Purpose flour | 30 grams |
| Tomato Juice | 120 grams |

The material was blended in a kitchen blender for 4 minutes until uniform. The material was basically an adaptation of an oven cleaner test described in Federal Specification P-C-1947B. The difference from the Federal Specification was that flour was substituted for tapioca to cause the test material to adhere more readily to the dishes. This material was selected in order to test the detergent composition on particularly difficult to remove foods and stains. A household automatic dishwasher was utilized and the tests were conducted in triplicate. Under all tests the composition of this invention performed satisfactorily in removing this difficult to remove material.

Glassware spotting was evaluated using ASTM D3556-76T procedure. The product of this invention performed satisfactorily in the prevention of water spots on glassware.

It is thus seen that this invention provides a non-granular composition for use within a household automatic dishwasher containing both detergency levels of surfactant and a chlorine bleach in a stable state. It is further seen that this invention provides not only a novel composition for use within a household automatic dishwasher, but additionally provides a novel process for dispensing and using a dishwasher detergent product. As many variations will be apparent to those skilled in the art from a reading of the above specification, such variations are included within the scope of this invention as defined by the following appended claims.

That which is claimed is:

1. A process for dispensing a dishwashing detergent composition, comprising the steps of:

providing a thixotropic dishwashing composition which comprises;

an aqueous solvent present in an amount of about 45 to 60% by weight of said composition, a thickening agent, having functional electrolytes in an amount sufficient to render said composition thixotropic, a chlorine source present in amount of from about 0.05 to about 5.% (percent) by weight of said composition, a buffer system to stabilize said chlorine source within said composition and-to maintain a pH within the range of about 10 to 13, an anionic surfactant present in an amount equivalent to about at least 0.5% (percent) by weight of said composition when added as a 30% (percent) aqueous solution, a builder salt present in an amount of from about 2 to about 40 percent by weight of said composition, said composition being formulated to be thixotropic and to have sufficient chlorine stability to be efficacious in an automatic dishwasher after one year storage at 77° F., said composition being in the form of a gel when at rest;

shearing said composition to form a sol with generally liquid-like properties; and dispensing said sol with generally liquid-like properties into an automatic dishwasher whereby said thixotropic composition regels within said dishwasher.

2. A process according to claim 1 wherein said thickening agent is selected from the group consisting of silicas, silicates, aluminosilicates and clays.

3. The process according to claim 1 wherein said buffer system comprises an alkali metal base and an alkali metal salt.

4. A process according to claim 3 wherein said alkali metal base is sodium hydroxide and said alkali metal salt is sodium carbonate.

5. A process according to claim 1 wherein said anionic surfactant is an alkali metal alkyl sulfate.

6. The process according to claim 5 wherein said anionic surfactant is sodium lauryl sulfate.

7. The process according to claim 1 wherein said chlorine source is a member selected from the group consisting of sodium hypochlorite, lithium hypochlorite, calcium hypochlorite and chlorinated trisodium phosphate.

8. A process according to claim 1 wherein said builder salt is tetrapotassium pyrophosphate.

9. The process according to claim 1 having sufficient stability to maintain greater than thirty-three percent (33%) of its original active chlorine after one year storage at 77 degrees F.

10. The process according to claim 1 comprising 0.05 to 5 weight percent of alkali metal hypochlorite as said chlorine source.

11. The process according to claim 10 having generally equal molar additions an alkali metal hydroxide and an alkali metal salt so as to minimize the formation of hypochlorous acid and to maintain a PH within the range of 10 to 13.

* * * * *